US010334907B2

(12) United States Patent
Hamner et al.

(10) Patent No.: US 10,334,907 B2
(45) Date of Patent: Jul. 2, 2019

(54) BIO HEEL PAD, BIO HEEL PAD SHOE AND METHODS OF MANUFACTURING SAME

(71) Applicant: BIOFOOTPAD, INC., Poway, CA (US)

(72) Inventors: Dyson Lister Hamner, Poway, CA (US); Theodore Voorhees Tillinghast, Cardiff, CA (US); Joseph John Jankiewicz, Coronado, CA (US); Mark Tabin McBride, Coronado, CA (US)

(73) Assignee: BioFoot Pad, Incorporated, Poway, CA (US)

( * ) Notice: Subject to any disclaimer, the term of this patent is extended or adjusted under 35 U.S.C. 154(b) by 150 days.

(21) Appl. No.: 15/436,780

(22) Filed: Feb. 18, 2017

(65) Prior Publication Data

US 2017/0156437 A1 Jun. 8, 2017

Related U.S. Application Data

(62) Division of application No. 14/696,885, filed on Apr. 27, 2015, now Pat. No. 9,609,909.

(51) Int. Cl.

| | |
|---|---|
| ***A43B 7/14*** | (2006.01) |
| ***A43B 13/38*** | (2006.01) |
| ***A43B 17/02*** | (2006.01) |

(52) U.S. Cl.

CPC ..... *A43B 7/144* (2013.01); *A43B 7/141* (2013.01); *A43B 7/149* (2013.01); *A43B 7/1475* (2013.01); *A43B 13/383* (2013.01); *A43B 17/026* (2013.01)

(58) Field of Classification Search

CPC ..... A43B 7/144; A43B 7/141; A43B 7/149; A43B 13/383; A43B 17/026; A34B 7/1475

USPC ..... 36/92, 50.1, 45, 58

See application file for complete search history.

(56) References Cited

U.S. PATENT DOCUMENTS

| | | | | |
|---|---|---|---|---|
| 3,555,706 | A | 1/1971 | Edmonds | |
| 4,391,048 | A | 5/1983 | Lutz | |
| 5,342,465 | A * | 8/1994 | Bronowicki | B32B 3/14 156/173 |
| 5,561,920 | A * | 10/1996 | Graham | A43B 1/0072 36/27 |
| 6,029,376 | A * | 2/2000 | Cass | A43C 1/04 36/50.1 |
| 6,127,010 | A | 10/2000 | Rudy | |
| 6,871,424 | B2 | 3/2005 | Labonte | |
| 6,968,636 | B2 | 11/2005 | Aveni et al. | |
| 7,222,442 | B2 | 5/2007 | Hillyer | |
| 7,401,422 | B1 | 7/2008 | Scholz | |
| 7,788,824 | B2 | 9/2010 | Hann | |
| 7,946,059 | B2 | 5/2011 | Borel | |
| 8,590,178 | B2 | 11/2013 | Avar | |
| 8,613,149 | B2 | 12/2013 | Schwirian | |
| 8,635,788 | B2 | 1/2014 | Aveni et al. | |

(Continued)

*Primary Examiner* — Alissa J Tompkins
*Assistant Examiner* — Catherine M Ferreira
(74) *Attorney, Agent, or Firm* — James R. McDaniel; Jerry R. Potts

(57) ABSTRACT

A shoe having a bio foot pad, including a plurality of circumferential elastic fibers surrounded by a viscoelastic material; wherein said fibers impart a biphasic characteristic to said viscoelastic material; and wherein said fibers under compression develop a plurality of hoop stresses to facilitate load conversion and distribution of axial forces exerted against a heel area of a user.

17 Claims, 7 Drawing Sheets

(56) References Cited

U.S. PATENT DOCUMENTS

| | | | | |
|---|---|---|---|---|
| 8,950,178 | B2 * | 2/2015 | Miki | F01N 13/1805 60/312 |
| 2013/0291399 | A1 | 11/2013 | Fonte et al. | |
| 2013/0296449 | A1 * | 11/2013 | Peterson | C08J 9/0009 521/122 |
| 2015/0082660 | A1 | 3/2015 | Ofray, Sr. | |

* cited by examiner

BIO HEEL PAD, BIO HEEL PAD SHOE AND METHODS OF MANUFACTURING SAME

The present application is a divisional patent application of U.S. patent application Ser. No. 14/696,885, filed on Apr. 27, 2015 the contents of which is incorporated herein by reference in its entirety.

FIELD OF THE INVENTION

This invention relates generally to a bio foot pad having circumferentially arranged, load distributing fibers that function to redistribute the axial forces exerted against the heel area of the user by resisting the build-up of tension within a network of circumferential fibers found in the construction of the bio foot pad and a method of using and manufacturing the same.

BACKGROUND OF THE INVENTION

Prior to the present invention, as set forth in general terms above and more specifically below, it is known, to employ various shock absorbing, cushioning devices suitable for footwear which include a compressible insert. See for example, U.S. Pat. No. 4,391,048 by Lutz, U.S. Pat. No. 5,561,920 by Graham et al., U.S. Pat. No. 6,127,010 by Rudy, U.S. Pat. No. 6,968,636 by Aveni et al., U.S. Pat. No. 7,788,824 by Hann, et al., U.S. Pat. No. 7,946,059 by Borel, U.S. Pat. No. 8,613,149 by Schwirian, U.S. Pat. No. 8,635,788 by Aveni et al., and U.S. Patent Application Publication 2013/0291399 by Fonte et al. While these various shock absorbing, cushioning devices which are suitable for footwear may have been generally satisfactory, there is nevertheless a need for a new and improved bio foot pad having a semi-lunar disk-like shape which is adapted to be received into a heel compartment area of a shoe in a snug friction tight fit such that the bio foot pad includes circumferentially arranged, load distributing fibers that function to redistribute the axial forces exerted against the heel compartment area of a user by resisting the build-up of tension within a network of circumferential fibers.

It is a purpose of this invention to fulfill this and other needs in the art in a manner more apparent to the skilled artisan once given the following disclosure.

SUMMARY OF THE INVENTION

In a first aspect, the present invention is a bio foot pad, comprising: a plurality of circumferential elastic fibers surrounded by a viscoelastic material; wherein the fibers impart a biphasic characteristic to the viscoelastic material; and wherein the fibers under compression develop a plurality of hoop stresses to facilitate load conversion and distribution of axial forces exerted against a heel area of a user.

In one embodiment of the first aspect of the present invention, the plurality of circumferential elastic fibers is provided with a pair of fiber termination ends; and wherein each one of the pair of fiber termination ends facilitates fiber end fixation to a heel compartment area of a shoe counter or to a removable bio foot pad.

In another embodiment of the first aspect of the present invention, the viscoelastic material has a general semi-lunar shape for snug friction tight insertion within the heel compartment area of the shoe counter to help facilitate the construction of a load converting and load distributing shoe.

In another embodiment of the first aspect of the present invention, the viscoelastic material includes a polymeric material.

In another embodiment of the first aspect of the present invention, the polymeric material includes polyurethane.

In another embodiment of the first aspect of the present invention, the polymeric material includes a polymer gel.

In another embodiment of the first aspect of the present invention, the polymeric material includes silicone.

In another embodiment of the first aspect of the present invention, the plurality of circumferential elastic fibers includes any suitable materials having a predominately elastic behavior with a linear type of load-elongation curve.

In another embodiment of the first aspect of the present invention, the plurality of circumferential elastic fibers includes a medical grade suture material.

In another embodiment of the first aspect of the present invention, a fixation means is used to facilitate fiber end fixation such that the fixation means includes any suitable polymeric material.

In another embodiment of the first aspect of the present invention, a fixation means is used to facilitate fiber end fixation such that the fixation means includes any suitable metallic material.

In a second aspect, the present invention is a shoe having a bio foot pad, including a shoe counter located substantially within the shoe; and a bio foot pad operatively connected to the shoe counter, wherein the bio foot pad comprises; a plurality of circumferential elastic fibers surrounded by a viscoelastic material, wherein the fibers impart a biphasic characteristic to the viscoelastic material, and wherein the fibers under compression develop a plurality of hoop stresses to facilitate load conversion and distribution of axial forces exerted against a heel area of a user.

In another embodiment of the second aspect of the present invention, the plurality of circumferential elastic fibers are provided with a pair of fiber termination ends; and wherein each one of the pair of fiber termination ends facilitates fiber end fixation to a heel compartment area of a shoe counter.

In another embodiment of the second aspect of the present invention, the viscoelastic material has a general semi-lunar shape for snug friction tight insertion within the heel compartment area of the shoe counter to help facilitate the construction of a load converting and load distributing shoe In another embodiment of the second aspect of the present invention, the shoe includes a removable insert located substantially adjacent to the shoe counter wherein the bio foot pad is operatively attached to the removable insert.

In another embodiment of the second aspect of the present invention, the plurality of circumferential elastic fibers includes a medical grade suture material.

In another embodiment of the second aspect of the present invention, a fixation means is used to facilitate fiber end fixation such that the fixation means includes any suitable polymeric material.

In another embodiment of the second aspect of the present invention, a fixation means is used to facilitate fiber end fixation such that the fixation means includes any suitable metallic material.

In a third aspect, the present is a method of using a bio foot pad in a shoe to redistribute axial forces exerted against a heel area of a user by resisting a build-up of tension within a plurality of circumferentially arranged, load distributing fibers, comprising the steps of: locating a shoe counter substantially within a shoe such that a heel compartment area of the shoe counter is located substantially adjacent to an area of the shoe where a user's heel is to be located; and operatively connecting a bio foot pad to the shoe counter whereby the bio foot pad in the shoe is used to redistribute axial forces exerted against the user's heel by resisting a build-up of tension within a plurality of circumferentially arranged, load distributing fibers.

In another embodiment of the third aspect of the present invention, the step of operatively connecting the bio foot pad to the shoe counter includes the step of: removably attaching a portion of the bio foot pad to a portion of the shoe counter.

The preferred bio foot pad, according to various embodiments of the present invention, offers the following advantages: ease of use; improved axial force re-distribution and shock absorption; improved heel protection from excessive forces; the ability to convert compressive forces into hoop stresses; the ability to convert axial forces into circumferential forces; increased contact area of the heel; the ability of the circumferential fibers to maintain the concavity of the bio foot pad unlike other pads that flatten out; and decreased forces on the bottom of the heel. In fact, in many of the preferred embodiments, these factors of improved axial force re-distribution and shock absorption, improved heel protection from excessive forces, the ability to convert compressive forces into hoop stresses, the ability to convert axial forces into circumferential forces, increased contact area of the heel, the ability of the circumferential fibers to maintain the concavity of the bio foot pad unlike other pads that flatten out, and decreased forces on the bottom of the heel are optimized to an extent that is considerably higher than heretofore achieved in prior, known foot pads.

BRIEF DESCRIPTION OF THE DRAWINGS

The above mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF PREFERRED EMBODIMENTS

Figure 1:
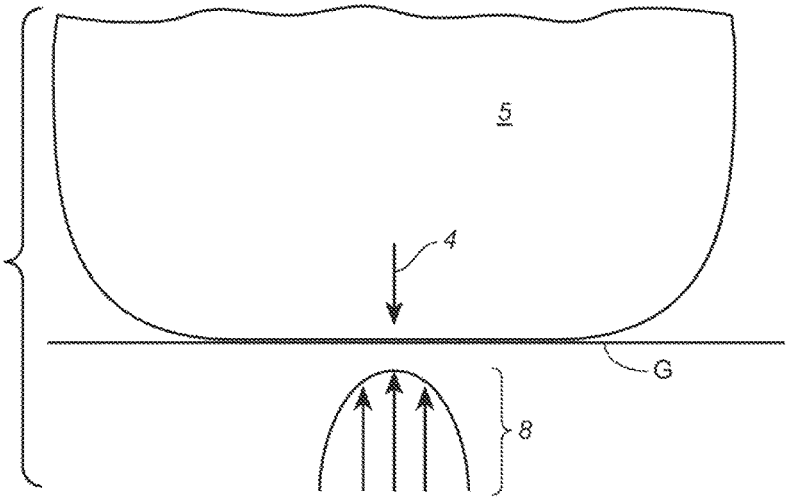
FIG. 1 is a schematic illustration showing localized forces on the heel of a user without the presence of a bio foot pad in a shoe.

In order to gain a complete understanding of the inventive concepts of the present invention, the following background is being provided. As shown in FIG. 1, for example, if a user is walking along the ground (G), the heel 5 of the user strikes the surface of the ground (G) along force vector 4. This interaction between heel 5 and ground (G) cause heel 5 to flatten out slightly and creates forces on the heel 5 which are localized along a small portion of the heel 5, as shown in force profile 8. Over extended periods of time, these localized forces on the heel 5 can become problematic for the user and result in heel and/or foot problems for the user. The present invention substantially reduces the likelihood of these problematic, localized forces occurring on the heel 5, as will be discussed now in greater detail.

Referring now to the drawings and more particularly to FIGS. 2-8, there is shown a bio foot pad 20 having circumferentially arranged, load distributing fibers 24 that function to redistribute the axial forces exerted against the heel area 5 (FIG. 3) of the user 32, which is constructed in accordance with the present invention. As will be explained hereinafter in greater detail, the bio foot pad 20 is constructed not as a shock absorbing cushion but instead is constructed to convert the compressive axial forces created by the heel 5 of the user 32 striking the heel area of his or her shoe 30 against the ground (G) into hoop stresses. Stated otherwise, the bio foot pad 20 functions to redistribute the axial forces exerted against the heel area 5 of the user 32 by resisting the build-up of tension within a network of circumferential fibers 24 (FIG. 2) found in the construction of the bio foot pad 20, which network of circumferential fibers will be described hereinafter in greater detail. The advantages of bio foot pad 20 are ease of use, improved axial force re-distribution and shock absorption, improved heel protection from excessive forces, the ability to convert compressive forces into hoop stresses, the ability to convert axial forces into circumferential forces, increased contact area of the heel, the ability of the circumferential fibers to maintain the concavity of the bio foot pad unlike other pads that flatten out, and decreased forces on the bottom of the heel. The important point here is that the point contact at the bottom of the heel area 5 is reduced because the load is now shared by a greater portion of the heel area 5 due to the increased contact area between the bio foot pad 20 and the heel area 5.

Figure 2:
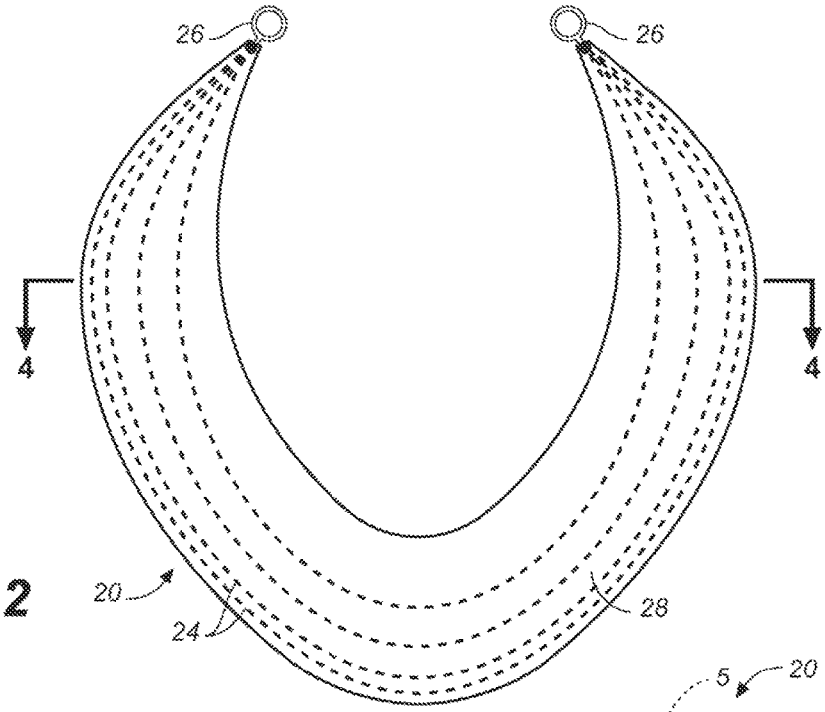
FIG. 2 is a schematic, top view illustration of a bio foot pad, constructed according to the present invention.

Referring now to the drawings and more particularly to FIGS. 2-8, there is illustrated a force converting bio foot pad or insert 20, which is constructed in accordance with the present invention. As best seen in FIG. 2, the bio foot pad 20 is configured in a general semi-lunar, disk-like shape which is adapted to be received into a heel compartment area 34 (FIG. 3) of shoe counter 36 in a snug friction tight fit. Bio foot pad 20 includes circumferentially arranged, load distributing fibers 24, fixations points 26, and viscoelastic material 28 which substantially surrounds fibers 24.

With respect to the shape of bio foot pad 20, bio foot pad 20, preferably, should be crescent or U-shaped. Ideally, the shape will be similar to the outer surface of the human heel 5. The shape is intended to functionally deepen heel counter 36 of the shoe 30. The bio foot pad 20 will load—share and reduce contact stresses on the heel 5. Unlike other known heel pads or cushions, bio foot pad 20 includes circumferentially arranged fibers 24 in the bio foot pad 20 and the ends of the bio foot pad will be secured to locations 39 (FIG. 3) of the shoe counter 36 at fixation points 26. This allows for a circumferential tensile force to develop in the bio foot pad 20. The load sharing capacity of the bio foot pad 20 is due to the stiffness created by the circumferential fibers 24.

With respect to circumferential fibers 24, circumferential fibers 24, preferably are constructed of any suitable materials that can demonstrate a predominately elastic behavior with a linear type of load-elongation curve, for example a medical grade suture material. It is to be understood that circumferential fibers 24 can also be constructed of, but not limited to, Nylon®, Dacron®, fluorocarbon materials, Kevlar®, carbon fiber, stainless steel, or any suitable metallic wire. Ideally, the circumferential fibers 24 should be fairly rigid and be able to elongate with compression of the bio foot pad 20 and then return to their initial length once the pressure from the heel 5 is removed. It is to be understood that circumferential fibers 24 must be oriented circumferentially with respect to bio foot pad 20. In this manner, circumferential fibers 24 will develop the proper tensile, load sharing stresses needed to redistribute the axial forces applied to heel 5. It should also be understood that other similarly shaped foot pads are extruded radially in the compressed state and essentially lose contact with the user's heel 5 if the shoe counter 36 is not close enough to the user's heel 5. Thus, another unique feature of the bio foot pad 20 is that due to the circumferential fibers 24, bio foot pad 20 does not rely on the shape of the shoe 30 (FIG. 3) to prevent the loss of contact between the user's heel 5 and the bio foot pad 20 from radial extrusion.

With respect to viscoelastic material 28, viscoelastic material 28, generally, is shaped to fit the contour of the user's heel 5. Also, viscoelastic material 28, preferably, is constructed of any suitable viscoelastic material such as polyurethane, polymer gel, rubber, and/or silicone. Ideally, the viscous portion of the viscoelastic material 28 allows for the bio foot pad 20 to conform to the shape of the heel 5 during heel strike and therefore causes the heel strike forces to be spread out more evenly, as will be discussed in greater detail later. Also, the elastic component of the bio foot pad 20 should allow the viscoelastic material 28 to return to its previous shape as the force is being transferred away from the heel 5 and to the forefoot 38 (FIG. 3) during walking. Finally, it is to be understood that the circumferential fibers 24 added to the viscoelastic material 28 of the bio foot pad 20 cause bio foot pad 20 to act in a biphasic manner: in an uncompressed state or in a compressed state.

Figure 3:
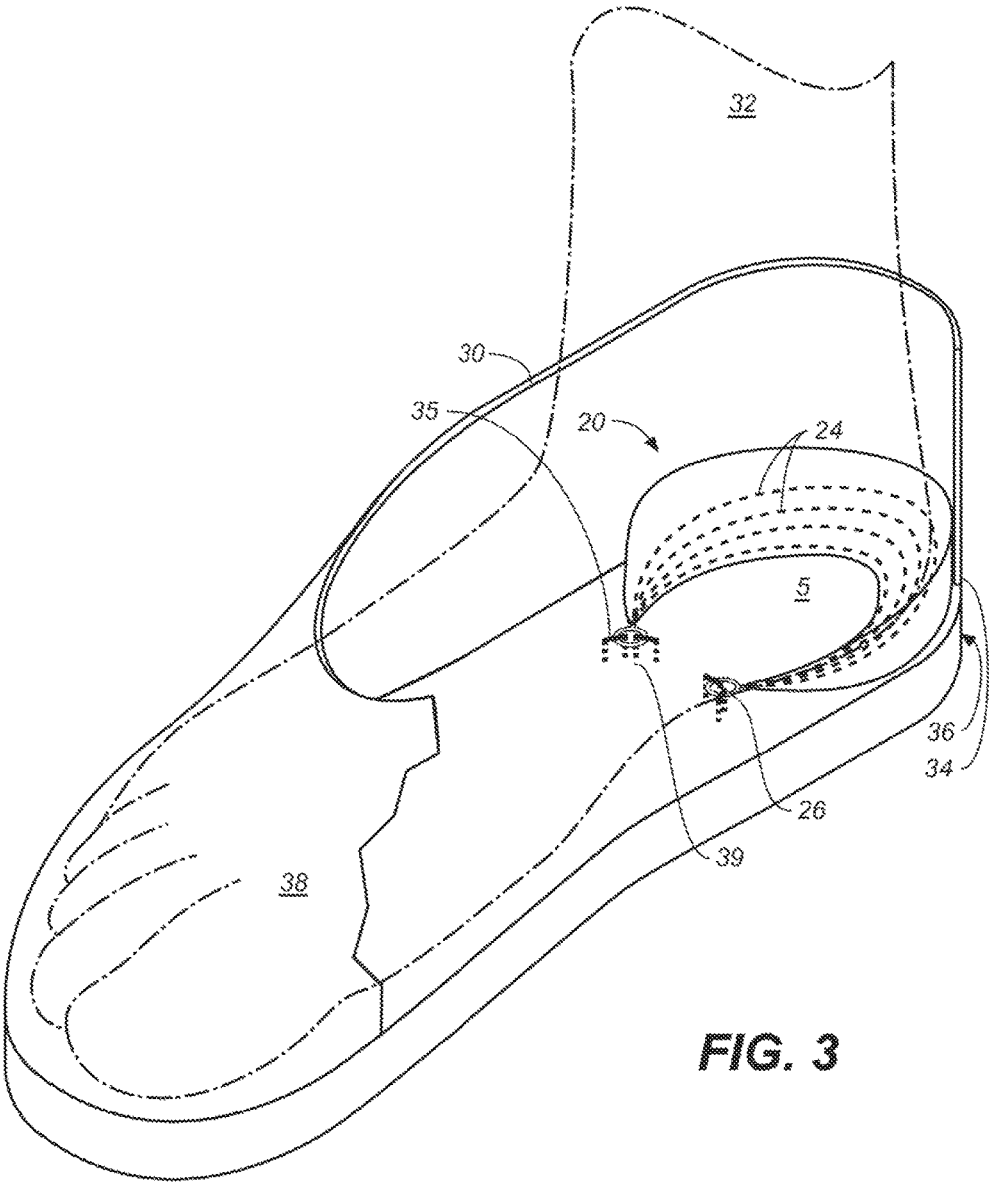
FIG. 3 is a schematic illustration of the bio foot pad being located within a shoe, constructed according to the present invention.

Regarding fixations points 26, fixations points 26, preferably, are any suitable polymeric and/or metallic connectors that are capable of being connected to the shoe counter 36 (FIG. 3). Preferably, fixation points 26 are spherical shapes that can easily be retained at locations 39 in shoe counter 36. As shown in FIG. 3, conventional staples 35 are used to retain fixation points 26 on shoe counter 36. Fixation points 26 allow the user to easily replace bio foot pad 20 by simply removing, for example, staples 35 from fixation points 26, removing bio foot pad 20 from shoe 30, inserting a new bio foot pad 20 into shoe 30 such that bio foot pad 20 is substantially located near shoe counter 36, and securing bio foot pad 20 onto shoe counter 36 with another set of staples 35.

Figure 5:
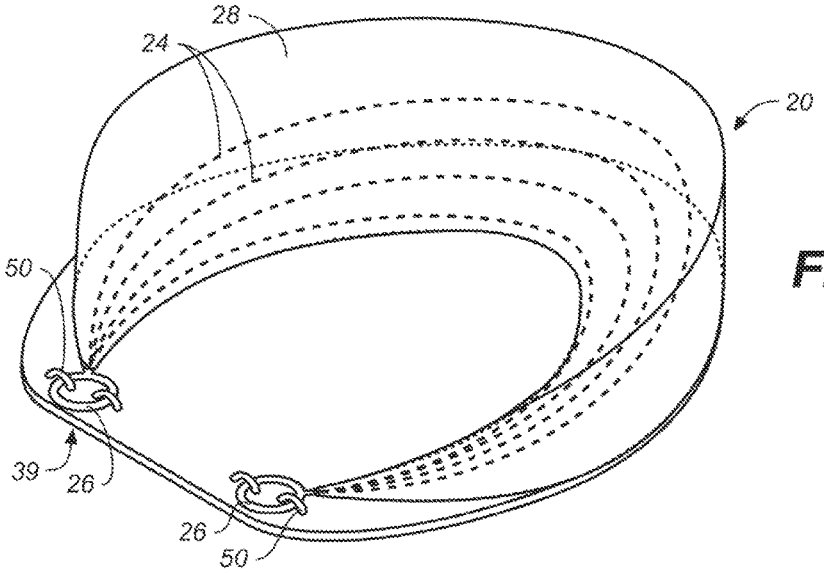
FIG. 5 is a schematic illustration of another bio foot pad, constructed according to the present invention.

As shown in FIG. 5, fixation points 26 have been secured to locations 39 by conventional stitches 50. Stitches 50, preferably, are constructed of any suitable durable metallic or polymeric material. It is to be understood that the bio foot pad 20, as shown in FIG. 5, is substantially similar to the bio foot pad 20 shown in FIG. 3 except that stitches 50 are utilized in the bio foot pad embodiment shown in FIG. 5.

Figure 6:
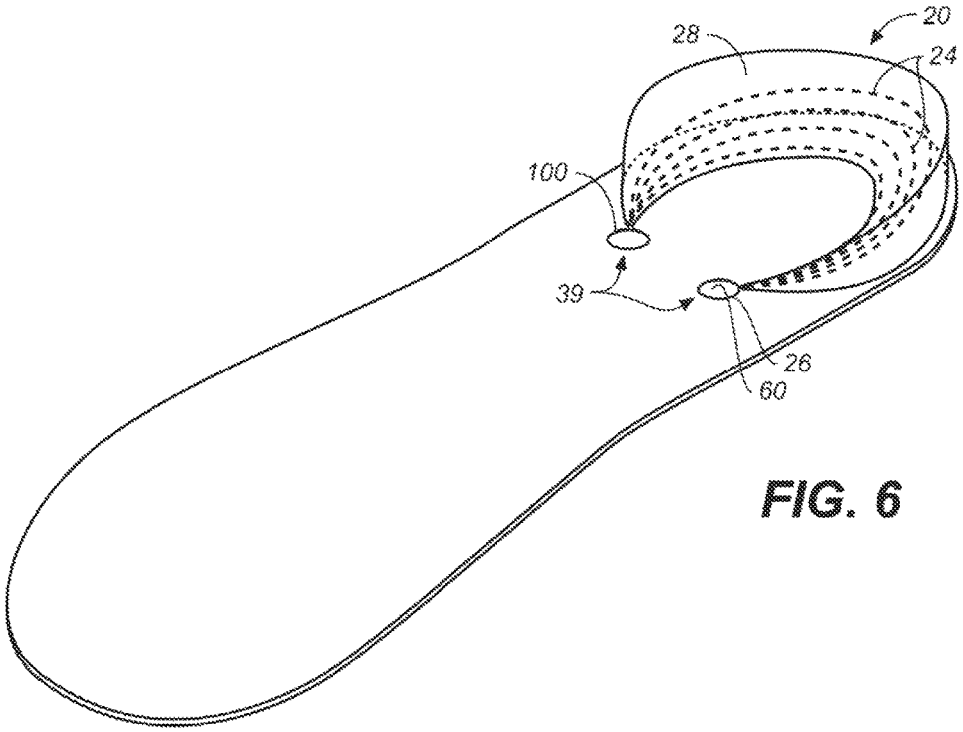
FIG. 6 is a schematic illustration of still another bio foot pad, constructed according to the present invention.

As shown in FIG. 6, fixation points 26 have been secured to locations 39 by conventional rivets 60. Rivets 60, preferably, are constructed of any suitable durable metallic or polymeric material. It is to be understood that the bio foot pad 20, shown in FIG. 6, is substantially similar to the bio foot pad 20 shown in FIG. 3 except that rivets 60 are utilized in the bio foot pad embodiment shown in FIG. 6. It is to be further understood that no matter how fixation points 26 are retained on shoe counter 36 (FIGS. 3 and 5-8), fixations points 26 must allow bio foot pad 20 to be retained within shoe counter 36, allow bio foot pad 20 to be compressed by heel 5, and allow bio foot pad 20 to revert back to its uncompressed state once the force has been transferred away from the heel 5 and back to the forefoot 38 (FIG. 3). Conversely, as discussed with respect to staples 50 in FIG. 3, it is to be understood that in the embodiments shown in FIGS. 5 and 6, it is desired that bio foot pad 20 will not be replaced. Instead, if bio foot pad 20 becomes worn out, the user will simply have to replace shoe 30.

Figure 4:
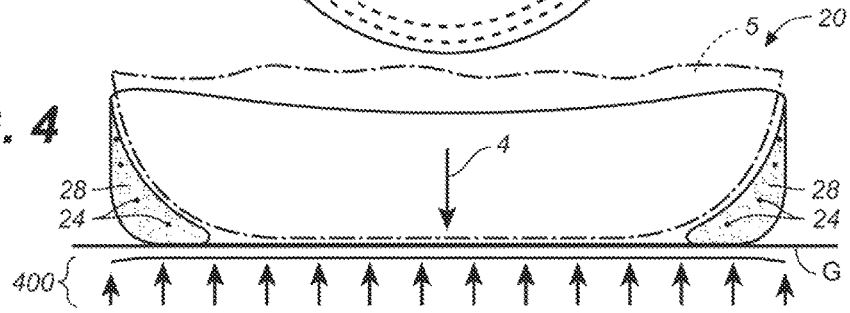
FIG. 4 is a cross-sectional view of a compressed bio foot pad showing the circumferential fibers located within the bio foot pad and localized forces on the heel of a user, taken along lines 4-4 of FIG. 2, constructed according to the present invention.

With respect to the cross-sectional shape of bio foot pad 20, as shown in FIG. 4, the wedge shaped cross sectional area of the bio foot pad 20 will allow increased load-share and reduce contact stresses on the heel 5 (FIG. 3) as the heel 5 is compressed into the bio foot pad 20. Also, the wedge shaped, cross sectional area will allow radial extrusion of the bio foot pad 20 as it is engaged by the heel 5. It is to be understood that the optimum cross sectional angle will be greater than 0 degrees and less than 90 degrees, depending upon the compressed or uncompressed state. In the compressed state, there will also be a concave shape to bio foot pad 20.

It is to be kept in mind that a flat bio foot pad does not optimize radial extrusion and serves only as a shock absorber and an angle that is too steep will not "hug" the heel 5 to provide increased load-share and reduce contact stresses on the heel 5 as the heel 5 is compressed into the bio foot pad 20 when heel 5 contacts ground (G). It is to be understood that the force of heel 5 interacting with ground (G) along the direction of arrow 4, causes tension along the circumferential fibers 24 such that the circumferential fibers 24 allow the forces exerted by heel 5 against ground (G) to be resisted by the build-up of hoop stresses in the circumferential fibers 24 and allow the force of heel 5 interacting with ground (G) to be more evenly spread out (force profile 400) along heel 5, as compared to the localized force profile (force profile 8), as illustrated in FIG. 1.

Figure 9:
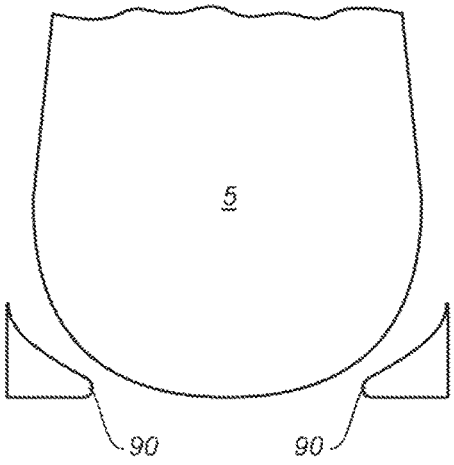
FIG. 9 (PRIOR ART)
FIG. 9 is a schematic, cross-sectional illustration of an uncompressed foot pad showing the heel prior to being placed in the foot pad, constructed according to the prior art.
Figure 11:
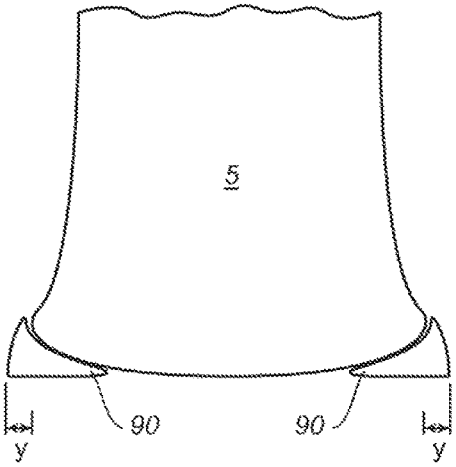
FIG. 11 (PRIOR ART)
FIG. 11 is a schematic, cross-sectional illustration of a compressed foot pad after the heel has been placed in the foot pad, constructed according to the prior art.
Figure 10:
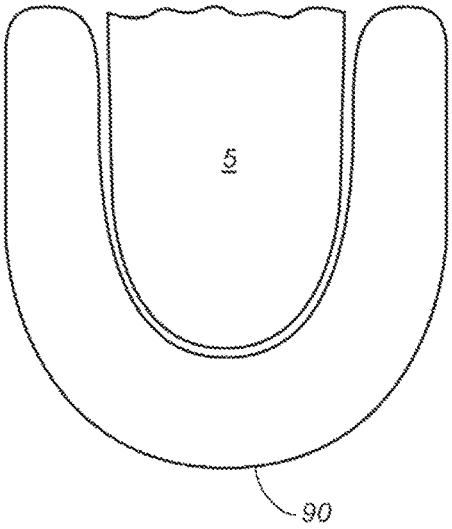
FIG. 10 (PRIOR ART)
FIG. 10 is a schematic, top view illustration of the uncompressed foot pad of FIG. 9 showing the heel prior to being placed in the foot pad, constructed according to the prior art.
Figure 12:
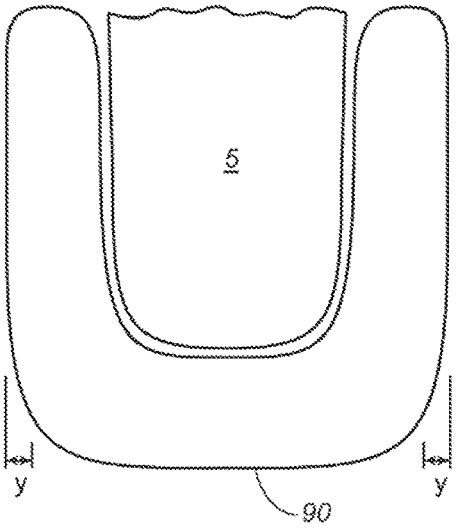
FIG. 12 (PRIOR ART)
FIG. 12 is a schematic, top view illustration of the compressed foot pad of FIG. 11 after the heel has been placed in the foot pad, constructed according to the prior art.

Considering now the application of a conventional foot pad, with reference to FIGS. 9-12, which is previously known to those skilled in the art. The conventional foot pad foot 90 is placed in a shoe which may or may not be attached to a shoe counter. As shown in FIGS. 9 and 10, the heel 5 is located adjacent to the conventional foot pad 90 so that neither the user's heel 5 nor the foot pad 90 is compressed. Once the heel 5 contacts the foot pad 90, both the heel 5 and the conventional foot pad 90 become compressed. The foot pad 90 is compressed in such a manner that it elongates radially outward along the direction of arrows y (FIGS. 11 and 12). However, due to the fact that the conventional foot pad 90 does not contain the circumferential fibers, the conventional foot pad 90 does not develop tensile, load sharing stresses that are used to redistribute the axial forces applied to heel 5. Also, as foot pad 90 is extruded radially in the compressed state, foot pad 90 may lose contact with the user's heel 5 if the shoe counter is not close enough to the user's heel 5.

Figure 13:
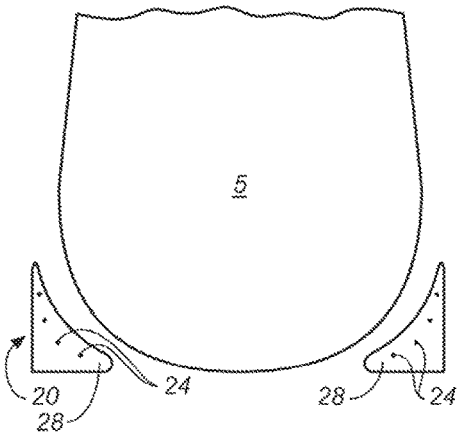
FIG. 13 is a schematic, cross-sectional illustration of an uncompressed bio foot pad showing the heel prior to being placed in the bio foot pad, constructed according to the present invention.
Figure 15:
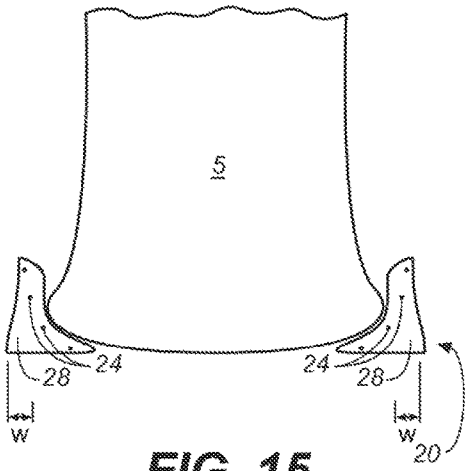
FIG. 15 is a schematic, cross-sectional illustration of a compressed bio foot pad after the heel has been placed in the bio foot pad, constructed according to the present invention.
Figure 14:
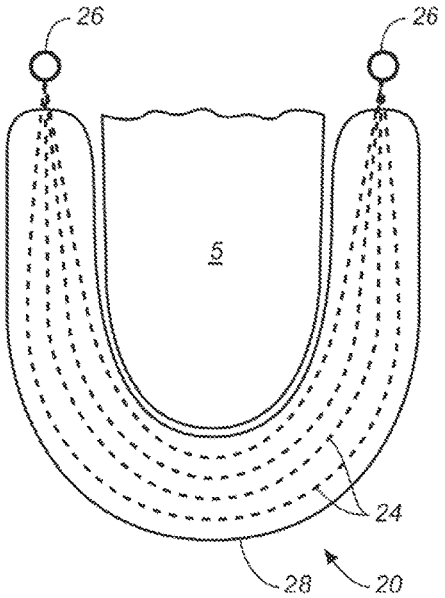
FIG. 14 is a schematic, top view illustration of the uncompressed bio foot pad of FIG. 13 showing the circumferential fibers located within the bio foot pad, constructed according to the present invention.
Figure 16:
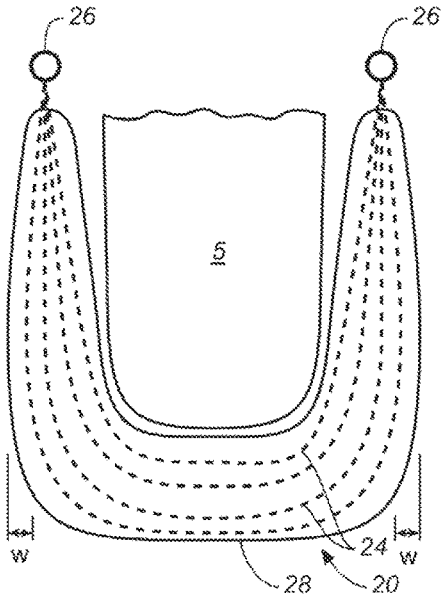
FIG. 16 is a schematic, top view illustration of the compressed bio foot pad of FIG. 15 showing the circumferential fibers under tension, constructed according to the present invention.

Considering now the application of bio foot pad 20, with reference to FIGS. 13-16, bio foot pad 20 is placed in shoe 30 and attached to shoe counter 36, as previously described (FIG. 3). As shown in FIGS. 13 and 14, heel 5 is located adjacent to bio foot pad 20 so neither heel 5 nor bio foot pad 20 are compressed. Once heel 5 contacts bio foot pad 20, both heel 5 and bio foot pad 20 become compressed. In fact, bio foot pad 20 is compressed in such a manner that it elongates radially outward along the direction of arrows w (FIGS. 15 and 16). To more dearly illustrate an inventive aspect of the present invention, as bio foot pad 20 becomes compressed by heel 5 and elongates radially outward along the direction of arrows w, bio foot pad 20 develops tensile, load sharing stresses that are used to redistribute the axial forces applied to heel 5 (FIGS. 15 and 16) which will be described in greater detail below.

Figure 17:
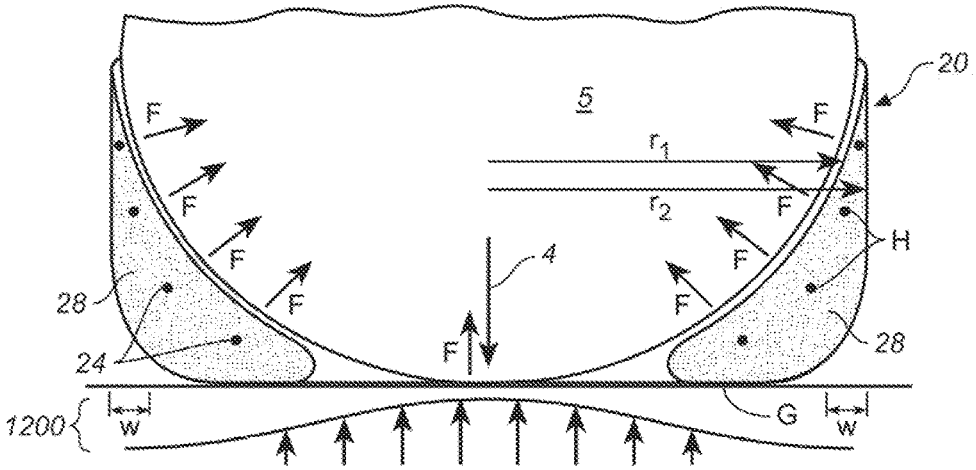
FIG. 17 is a schematic, cross-sectional illustration showing the development of hoop stresses in the bio foot pad once the heel of the user interacts with the bio foot pad, constructed according to the present invention.

With respect to FIG. 17, FIG. 17 illustrates how hoop stresses are utilized to convert the ground projecting axial force 4 directed against the heel 5 of the user into a circumferential force. The conversion or redistribution of this axial force 4 result in a significant reduction in the impact force experienced by the heel 5 of the user, as shown in the force profile 1200. As shown in FIG. 17, the force profile 1200 illustrates that forces experienced by the heel 5 are more evenly spread out along heel 5, as discussed previously. Thus, bio foot pad 20 functions to effectively eliminate pain in the heel 5 of the user, which would otherwise be generated by too much impact force on or against the bottom of the heel 5. It is to be further understood that while bio foot pad 20 is not a shock absorbing device, it may be used in combination with a conventional shock absorbing device.

It is to be further understood that the construction of the bio foot pad 20 is unique and novel, in that its construction not only redistributes the axial forces, but it also allows radial extrusion of the bio foot pad 20 which in turn, increases the contact area of the heel 5. The radial extrusion of the bio foot pad 20 (FIG. 17) functions to decrease the force in the bottom area of the heel 5, while the network of circumferential fibers 24 of the bio foot pad 20 function to resist those extrusion forces. This combination of actions converts and redistributes the compressive axial forces to hoop stresses which protect the heel 5 of the user by reducing excessive point contact forces at the bottom of heel 5. Bio foot pad 20 uniquely redistributes the force away from the bottom of heel 5 to the entire outside of heel 5, as depicted by force arrows (F).

In order to provide further insight into how the tensile, load sharing stresses are used to redistribute the axial forces applied to heel 5, a more detailed analysis of FIG. 17 is now provided. As shown in FIG. 17, as heel 5 contacts ground (G) along the downward direction of arrow 4, the force of heel 5 against bio foot pad 20 causes bio foot pad 20 to become compressed by heel 5 and elongate radially outward along the direction of arrows w. The circumferential fibers 24 transfer forces of the heel 5 interacting with ground (G) and the forces exerted against bio foot pad 20 as bio foot pad 20 elongates along the direction of arrows w when heel 5 contacts ground (G) by developing hoop (circumferential) stresses (H) within the circumferential fibers 24. The tensile stresses (H) resulting from the forces of the heel 5 interacting with ground (G) and the forces exerted against bio foot pad 20 are transferred along the circumferential fibers 24. More particularly, as the heel 5 interacts with ground (G), bio foot pad 20 will elongate peripherally along the direction of arrows w. This elongation is substantially prevented by the circumferential fibers 24. Because of an increase of the radius of the bio foot pad 20 (a change in the radius from $r_1$ to $r_2$) simultaneously increases the circumference of bio foot pad 20 (as shown in FIG. 17) a circumferential tension develops within the circumferential fibers 24, thereby opposing further displacement of bio foot pad 20. This is referred to as "hoop stresses". Therefore, the force of heel 5 interacting with ground (G) along the direction of arrow 4, causes tension along the circumferential fibers 24 such that the circumferential fibers 24 allow the forces exerted by heel 5 against ground (G) to be resisted by the build-up of hoop stresses in the circumferential fibers 24 and allow the force of heel 5 interacting with ground (G) to be more evenly spread out (force profile 1200) along heel 5, as compared to the localized force profile (force profile 8), as illustrated in FIG. 1.

Figure 18:
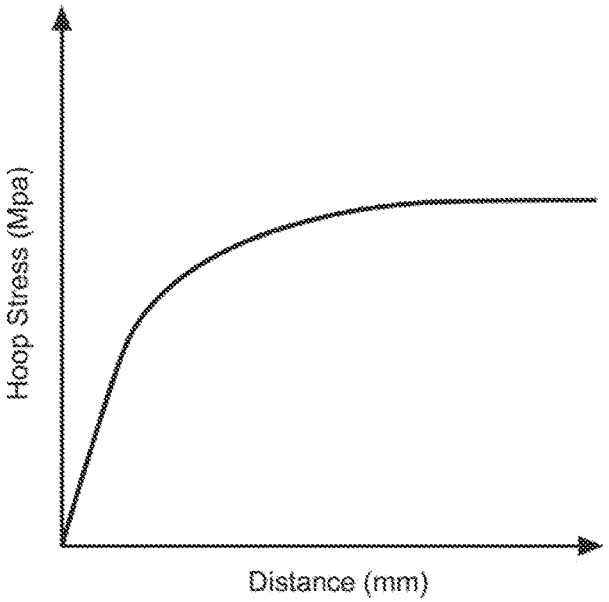
FIG. 18 is a graphical illustration showing the biphasic development of hoop stresses in the bio foot pad once the heel of the user interacts with the bio foot pad, constructed according to the present invention.

In order to further understand the use of hoop stresses to counter the forces exerted by heel 5 against ground (G), FIG. 18 provides a biphasic representation, whereby the bio foot pad 20 (FIG. 2) can be described as a mixture of solid and fluid components and that the fluid phase of the biphasic representation carries a significant part of the applied load. Thus, when heel 5 contacts ground (G), a load is applied to bio foot pad 20 and, predominantly, circumferential fibers 28 exhibit an elastic response. However, simultaneously, the bio foot pad 20 carries the compressive load and is elongated (as shown in the x-axis as distance) at a rate dependent on the viscoelasticity of the bio foot pad 20. The bio foot pad 20 therefore exhibits viscoelastic behavior. As shown in FIG. 18, if a constant compressive load (force 4 in FIG. 2) is applied by heel 5 against ground (G), there is an initial compression that is near-linear, and which predominantly represents the solid phase of the bio foot pad 20, i.e. the elastic behavior of the circumferential fibers 24 and viscoelastic material 28. This immediate phase is followed by a curved phase where there is a continued compression of the bio foot pad 20, but at a diminishing rate. This second stage is where the fluid-phase predominates, and viscoelastic material 28 is extruding along the direction of arrows w (FIG. 18). The continued but diminishing compression is referred to as creep, and can be seen when the extruding of viscoelastic material 28 (along the x-axis) in bio foot pad 20 is plotted against time (along the y-axis).

Figure 7:
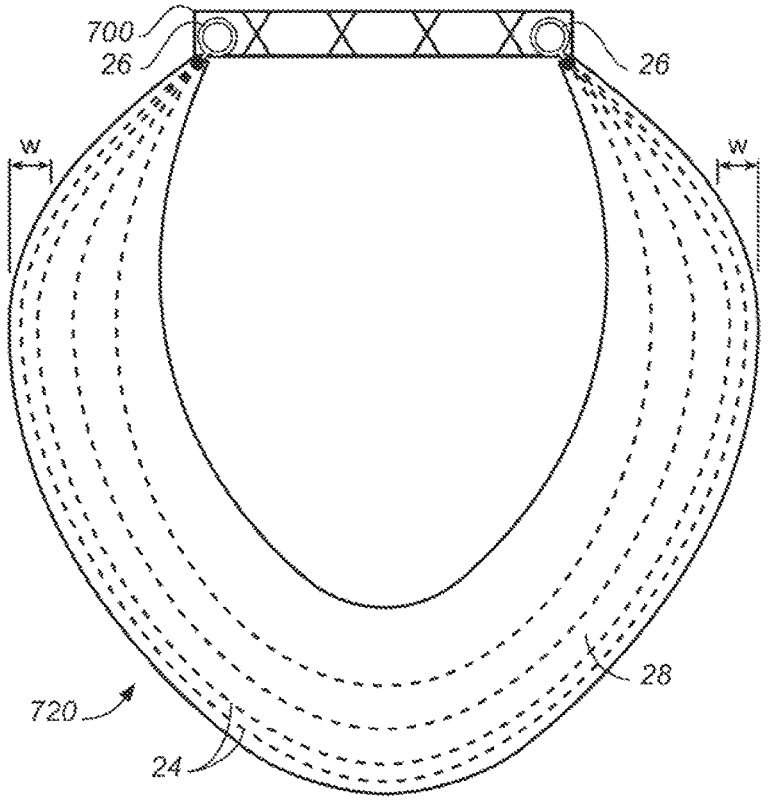
FIG. 7 is a schematic, top view illustration of another bio foot pad, constructed according to the present invention.

Referring now to the drawings and more particularly to FIG. 7, there is illustrated another bio pad 720 for a shoe. The bio foot pad 720 is configured in a similar manner as bio foot pad 20 (FIG. 2). However, the fixation points 26 are substantially retained within viscoelastic holder 700. Viscoelastic holder 700 is conventionally retained at locations 39 in shoe counter 36. Bio foot pad 720 is simply inserted into the shoe 30 in a similar manner to other removable inserts. Viscoelastic holder 700 is used to substantially prevent radial extrusion of bio foot pad 720 along the direction of arrows w. Preferably, viscoelastic holder 700 is constructed of any suitable, durable viscoelastic material but it is desired that the material used for viscoelastic holder 700 exhibits less viscoelasticity (it is a stiffer material) than the viscoelastic material 28 used to construct bio foot pad 20 (FIG. 2).

Figure 8:
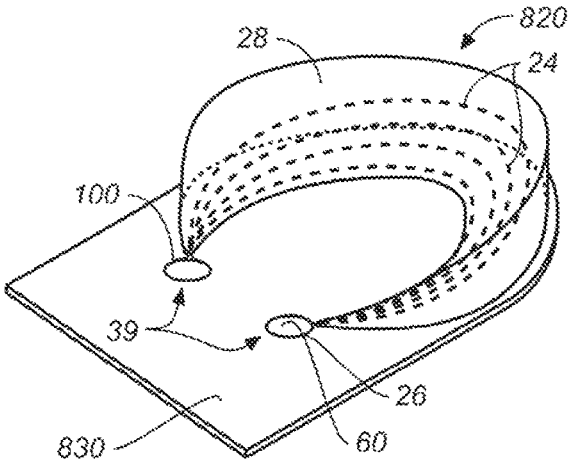
FIG. 8 is a schematic illustration of yet another bio foot pad, constructed according to the present invention.

Referring now to the drawings and more particularly to FIG. 8, there is illustrated another bio foot pad 820 for a shoe. The bio foot pad 820 is configured in a similar manner as bio foot pad 20 (FIG. 2). However, bio foot pad 820 is attached at fixation points 26 to a conventional removable flat insert 830. Removable flat insert 830, preferably, is constructed of any suitable substantially rigid material, such as, but not limited to, thermoplastics, thermoset composites such as carbon fibers, or leather. It is to be understood that bio foot pad 820 can be attached to removable flat insert 830 by any suitable attachment means such as staples, rivets, stitches or the like, as previously described. However, in this embodiment, when bio foot pad 820 becomes worn out, the user merely has to remove flat insert 830 which has bio foot pad 820 attached to it and replace removable flat insert 830 with a new removable flat insert 830 such that the removable flat insert 830 and bio foot pad 820 are located substantially adjacent to the shoe counter 36 (FIG. 3).

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Applicants reserve the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention.

The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context dearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein are a new and improved bio foot pad and a novel method of using the bio foot pad. The preferred bio foot pad, according to various embodiments of the present invention, offers the following advantages: ease of use; improved axial force re-distribution and shock absorption; improved heel protection from excessive forces; the ability to convert compressive forces into hoop stresses; the ability to convert axial forces into circumferential forces; increased contact area of the heel; the ability of the circumferential fibers to maintain the concavity of the bio foot pad unlike other pads that flatten out; and decreased forces on the bottom of the heel. In fact, in many of the preferred embodiments, these factors of improved axial force re-distribution and shock absorption, improved heel protection from excessive forces, the ability to convert compressive forces into hoop stresses, the ability to convert axial forces into circumferential forces, increased contact area of the heel, the ability of the circumferential fibers to maintain the concavity of the bio foot pad unlike other pads that flatten out, and decreased forces on the bottom of the heel are optimized to an extent that is considerably higher than heretofore achieved in prior, known bio foot pads.

We claim:

1. A shoe having a bio foot pad for insertion into the shoe, comprising:

a shoe counter having a bio foot pad, wherein the bio foot pad includes a plurality of circumferential elastic fibers uniformly located in an arcuate orientation throughout a viscoelastic material such that each fiber includes first and second fiber termination ends, wherein all of the first fiber termination ends are connected together and all of the second fiber termination ends are connected together at separate locations outside of the viscoelastic material for fixation to the shoe counter;

wherein the circumferential elastic fibers react to biphasic properties of the viscoelastic material such that the biphasic properties include a non-elastic phase and an elastic phase; and wherein the circumferential elastic fibers are configured to, under a compression of the viscoelastic material due to an interaction of a heel area of a user of the shoe with the viscoelastic material that generates the elastic phase, develop a plurality of hoop stresses that allow axial forces exerted against the heel area of the user of the shoe to be evenly distributed along the heel area of the user of the shoe.

2. The shoe having a bio foot pad, as in claim 1, wherein the shoe is further comprised of:

a heel compartment area located adjacent to the shoe counter, wherein each one of the first and second fiber termination ends is operatively attached to the heel compartment area of the shoe counter.

3. The shoe having a bio foot pad, as in claim 2, wherein the viscoelastic material has an arcuate shape for insertion within the heel compartment area of the shoe counter that is configured to allow axial forces exerted against the heel area of the user of the shoe to be evenly distributed along the heel area of the user of the shoe.

4. The shoe having a bio foot pad, as in claim 1, wherein the viscoelastic material is further comprised of:

a polymeric material.

5. The shoe having a bio foot pad, as in claim 4, wherein the polymeric material is further comprised of:

polyurethane.

6. The shoe having a bio foot pad, as in claim 4, wherein the polymeric material is further comprised of:

a polymer gel.

7. The shoe having a bio foot pad, as in claim 4, wherein the polymeric material is further comprised of:

silicone.

8. The shoe having a bio foot pad, as in claim 1, wherein the plurality of circumferential elastic fibers is further comprised of:

materials having an elastic characteristic with a linear load elongation curve.

9. The shoe having a bio foot pad, as in claim 8, wherein the plurality of circumferential elastic fibers is further comprised:

a suture material.

10. The shoe having a bio foot pad, as in claim 2, wherein the bio foot pad includes fixation points for operatively attaching the first and second fiber termination ends to the heel compartment area of the shoe counter wherein the fixation points are further comprised of:

a polymeric material.

11. The shoe having a bio foot pad, as in claim 2, wherein the bio foot pad includes fixation points for operatively attaching the first and second fiber termination ends to the heel compartment area of the shoe counter wherein the fixation points are further comprised of:

a metallic material.

12. A shoe having a bio foot pad, comprising:

a shoe counter, wherein a bio foot pad is operatively attached to the shoe counter such that the bio foot pad includes a plurality of circumferential elastic fibers uniformly located in an arcuate orientation throughout a viscoelastic material such that each fiber includes first and second fiber termination ends, wherein all of the first fiber termination ends are connected together and all of the second fiber termination ends are connected together at separate locations adjacent to the viscoelastic material for attachment to a heel compartment area of a shoe counter;

wherein the circumferential elastic fibers react to biphasic properties of the viscoelastic material such that the biphasic properties include a non-elastic phase and an elastic phase; and wherein the circumferential elastic fibers are configured to, under a compression of the viscoelastic material due to an interaction of a heel of a user of the shoe with the viscoelastic material that generates the elastic phase, develop a plurality of hoop stresses that allow axial forces exerted against the heel of the user of the shoe to be distributed along the heel of the user of the shoe.

13. The shoe having a bio foot pad, as in claim 12, wherein the viscoelastic material has an arcuate shape for insertion within the heel compartment area of the shoe counter that is configured to allow axial forces exerted against the heel of the user of the shoe to be distributed along the heel of the user of the shoe.

14. The shoe having a bio foot pad, as in claim 12, wherein the viscoelastic material is further comprised of:

a polymeric material.

15. The shoe having a bio foot pad, as in claim 12, wherein the plurality of circumferential elastic fibers is further comprised of:

materials having an elastic characteristic with a linear load elongation curve.

16. A shoe having a bio foot pad for insertion into a shoe, comprising:

a shoe counter, wherein a bio foot pad is operatively attached to the shoe counter such that the bio foot pad includes a plurality of circumferential elastic fibers uniformly located in an arcuate orientation throughout a viscoelastic material such that each fiber includes first and second fiber termination ends, wherein the circumferential elastic fibers have an elastic characteristic with a linear load elongation curve, wherein all of the first fiber termination ends are connected together and all of the second fiber termination ends are connected together at separate locations outside of the viscoelastic material for attaching to a heel compartment area of a shoe counter, wherein the viscoelastic material exhibits biphasic properties including a non-elastic phase and an elastic phase, wherein the viscoelastic material has an arcuate shape for insertion within the heel compartment area of the shoe counter that allows axial forces exerted against a heel area of a user of the shoe to be distributed along the heel area of the user of the shoe;

wherein the circumferential elastic fibers react to the biphasic properties of the viscoelastic material; and wherein the circumferential elastic fibers are configured to, under a compression of the viscoelastic material due to an interaction of a heel of the user of the shoe with the viscoelastic material that produces the elastic phase, develop a plurality of hoop stresses that allow axial forces exerted against the heel area of the user of the shoe to be distributed along the heel area of the user of the shoe.

17. The shoe having a bio foot pad, as in claim 16, wherein the viscoelastic material is further comprised of:

a polymeric material.

* * * * *